US006285773B1

(12) United States Patent
Carme et al.

(10) Patent No.: US 6,285,773 B1
(45) Date of Patent: Sep. 4, 2001

(54) LINEAR LOUDSPEAKER

(75) Inventors: Christian Carme, Marseilles; Marc Rehfeld, Ezanville, both of (FR)

(73) Assignees: Technofirst, Aubagne; Saint-Gobain Vitrage, Courbevoie, both of (FR)

( * ) Notice: Subject to any disclaimer, the term of this patent is extended or adjusted under 35 U.S.C. 154(b) by 0 days.

(21) Appl. No.: 09/462,907

(22) PCT Filed: Jul. 23, 1998

(86) PCT No.: PCT/FR98/01636

§ 371 Date: Apr. 13, 2000

§ 102(e) Date: Apr. 13, 2000

(87) PCT Pub. No.: WO99/05888

PCT Pub. Date: Feb. 4, 1999

(30) Foreign Application Priority Data

Jul. 23, 1997 (FR) ..... 97 09605

(51) Int. Cl.[7] ..... H04R 25/00

(52) U.S. Cl. ..... 381/418; 381/398; 381/423; 381/431; 181/150; 181/173; 181/171

(58) Field of Search ..... 381/336, 345, 381/362, 163, 386, 390, 395, 398, 420, 421, 423, 431, 418, 151, FOR 163, 153, 159, 162, 165; 181/150, 161, 162, 165, 171, 173

(56) References Cited

U.S. PATENT DOCUMENTS 4,550,428 10/1985 Yanagishima et al. .
4,792,978 12/1988 Marquiss .
5,430,805 * 7/1995 Stevenson .
5,714,722 * 2/1998 Naponen .
5,883,967 * 3/1999 House .
5,953,438 * 9/1999 Stevenson .
6,137,891 * 10/2000 Porazzo .
6,175,636 * 1/2001 Norris .
6,188,772 * 2/2001 Norris .

FOREIGN PATENT DOCUMENTS 0710946 5/1996 (EP) .
1494593 12/1977 (GB) .
2055015 2/1981 (GB) .
58-222700 12/1983 (JP) .

* cited by examiner

*Primary Examiner*—Curtis Kuntz
*Assistant Examiner*—Dionne N Harvey
(74) *Attorney, Agent, or Firm*—Oliff & Berridge, PLC

(57) ABSTRACT

The invention concerns a loudspeaker having an elongate parallelepiped hollow body, whereof one longitudinal surface is made up of a stretched elongate rectangular planar diaphragm. The diaphragm is suspended by its edges to the body adjacent side surfaces, and is integral with an elongate rigid inner part extending in the body longitudinal direction, and bearing a mobile electromagnetic coil, parallel to the diaphragm. The coil is arranged between two fixed magnets located along the body two longitudinal side surfaces which form, with the base of said body, polar parts. Said loudspeaker is useful as component of an active anti-noise system, associated with a double glazing.

8 Claims, 2 Drawing Sheets

LINEAR LOUDSPEAKER

FIELD OF THE INVENTION

The present invention relates to a loudspeaker, which is characterized by a particular geometrical shape and a particular overall design.

BACKGROUND OF THE INVENTION

At present, in practice there exist only loudspeakers with conical diaphragms, the diameter of which is at least equal to 3 cm, and the depth of which always exceeds 2 cm. In general, conventional loudspeakers, especially those possessing some power, are of bigger dimensions, and given their customary shape and their bulk, they cannot be housed in a small volume and, in particular, in a narrow space. These drawbacks render current loudspeakers in particular unsuitable for use in certain specific applications, especially in active soundproofing systems which create "anti-noise".

However, .U.S Pat. No. 4,792,978 discloses a loudspeaker describable as "linear", in the sense that it possesses an elongate rectangular shape, and comprises a diaphragm of corresponding shape, set vibrating by an electromagnetic system with coil of oblong shape. The coil, attached to the diaphragm, here runs in a plane perpendicular to the said diaphragm. This coil moves between elongate permanent magnets of opposite polarities. It follows that the coil does not move in a homogeneous and closed magnetic field, thus detracting from the sound restitution quality of the coil.

U.S. Pat. No. 4,550,428 describes a loudspeaker of conventional general shape, that is to say circular, comprising a cylindrical coil parallel to the diaphragm, an annular permanent magnet and a central pole piece. Despite the arrangement of the coil, this document remains far from the subject matter of the present invention.

European patent application No. 0 710 946 reveals an acoustic attenuation device, having an active double wall, using loudspeakers arranged as the border of a double wall, such as a double glazing, in the air gap between the two walls. However, this device uses circular loudspeakers, of considerable diameter, and can therefore be applied only to double glazings with a thick air gap.

The present invention aims to remedy all the aforesaid drawbacks, by providing a loudspeaker of "linear" type, which can be housed in a reduced volume and especially in a narrow space, whilst possessing comparable efficiency to that of a conventional loudspeaker which would be unable to fit into the same volume, this loudspeaker moreover having excellent quality of sound restitution.

To this end, the subject of the invention is essentially a loudspeaker of elongate overall shape, termed a linear loudspeaker, comprising a parallelepipedal hollow body of elongate shape, a longitudinal face of which consists at least partially of a plane diaphragm of elongate rectangular shape, suspended by its edges from the adjacent lateral faces of the said body or under the base of the said body, and integral with an elongate internal rigid wing which runs in the longitudinal direction of the said body, substantially in the midplane of the latter, and which bears a moving electromagnetic coil of elongate profile, located between two fixed elongate magnets, associated with fixed pole parts, characterized in that the moving electromagnetic coil is parallel to the diaphragm, and arranged between two fixed elongate magnets located respectively along two longitudinal lateral faces of the said body, these lateral faces and the base of the body forming fixed pole parts, which also comprise a central fixed pole part, situated in the longitudinal midplane of the body and received in a longitudinal recess of the internal rigid wing of the diaphragm, the said diaphragm thus being stretched in such a way as to allow its symmetric deformation on either side of its position of rest, in the course of the vibrational motion of this diaphragm when the loudspeaker is excited.

According to a preferred embodiment of the invention, the elongate plane diaphragm is composed of a rigid part, covered with an elastic film, and/or comprises such a film, of which the edges are fixed onto the adjacent lateral faces or under the base of the body of the loudspeaker, this fixing being achievable by gluing or by mechanical crimping. The elastic film is itself attached to the rigid part of the diaphragm by gluing, or by overmolding, or else by a mechanical link.

Thus, the invention proposes a loudspeaker whose diaphragm is not conical as in a conventional loudspeaker, but possesses a specific geometry, in this instance a plane, rectangular and elongate shape, which is therefore narrow in one direction and highly stretched in another direction, in relation to the elongate parallelepipedal overall shape of the loudspeaker, thereby justifying its description as a linear loudspeaker. The diaphragm of the loudspeaker which is the subject of the invention possesses just one external or peripheral suspension, unlike the conical diaphragms of the conventional loudspeakers which possess an external suspension and an internal suspension (the latter being customarily described as a "spider"). Additionally, contrary to a conventional loudspeaker, not only certain pole parts but also the magnets are located outside the coil, the internal rigid leaf of the diaphragm being however recessed so as to receive the central fixed pole part, situated in the longitudinal midplane of the body of the loudspeaker.

The geometrical shape and the particular arrangement of the constituent elements of the loudspeaker thus achieve optimization, making it possible for example to obtain a loudspeaker with a width of 2 cm, a depth of 2 cm and a bigger or smaller length, for example of the order of 50 cm, possessing very satisfactory efficiency. In particular, given the considerable length of the diaphragm, the latter displaces a large mass of air during its vibration, thereby affording good efficiency in the low frequencies. By virtue of its elongate coil, running practically over the entire length of the diaphragm, beneath the latter, and to the compactness of the loudspeaker which is the subject of the invention.

Moreover, with the suspension proposed by the invention, the diaphragm is suspended in such a way as to be stretched permanently and in a "balanced" manner, that is to say engendering the same elastic restoring force for a displacement in either direction of the internal rigid part attached to this diaphragm, so that the latter has, in the course of its vibrational motion, a symmetric deformation on either side of its position of rest. Stated otherwise, the deformation of the vibrating diaphragm is the same (in absolute value), for a positive or negative half-wave of the electrical signal applied to the input of the loudspeaker. The symmetric deformation of the vibrating diaphragm makes it possible to ensure good linearity of electromechanical conversion, especially at low frequencies, by avoiding the distortion phenomena which disturb sound restitution in general but also for the particular applications of an active anti-noise system. The suspension embodied according to the invention is furthermore very flexible, this leading to high efficiency of the transducer.

It will also be noted that, by means of the tension of the diaphragm, the restoring force can be adjusted, as a function of the requirements of the passband needed for use, as well as the distortion needed for the application, be it soundproofing, or active anti-noise, by applying the law F=kx.

The orientation of the coil parallel to the diaphragm (whereas it is perpendicular thereto in the aforesaid U.S. Pat. No. 4,792,978), also leads to the coil being situated and displaced in a homogeneous and closed magnetic field, to which the central pole part contributes, this also being important in obtaining optimal behavior of the diaphragm.

According to one mode of execution of the invention, the diaphragm runs along the entire length of the body of the loudspeaker.

DETAILED DESCRIPTION OF THE PREFERRED EMBODIMENTS.

Figure 1:
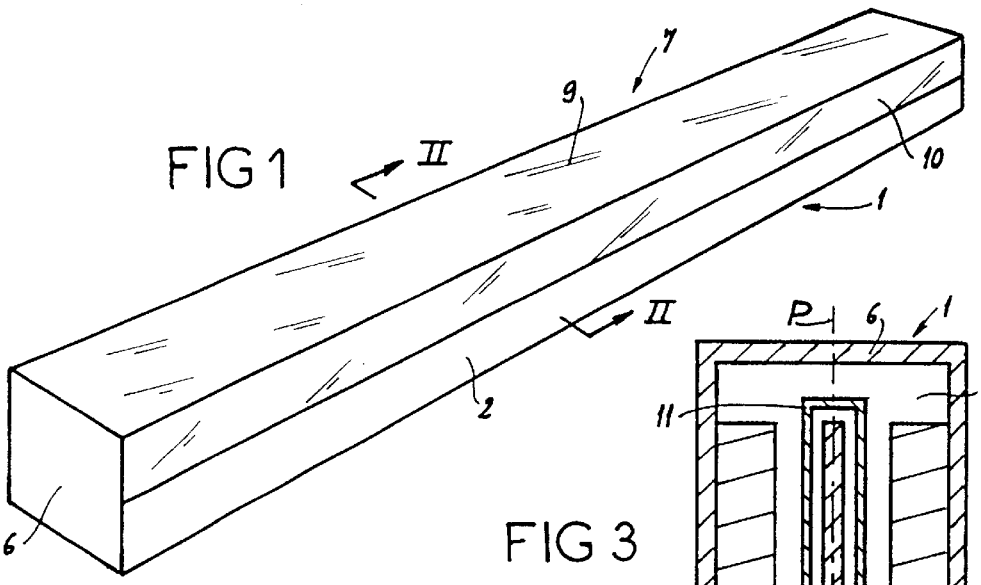
FIG. 1 is an overall view, in perspective, of a loudspeaker in accordance with the present invention.
Figure 3:
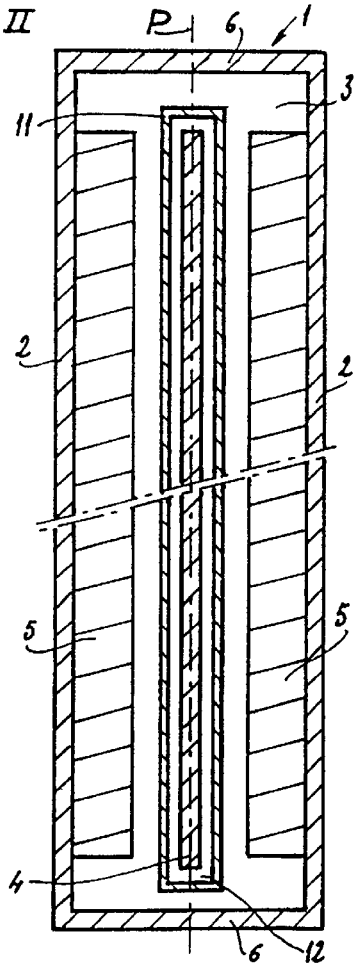
FIG. 3 is a longitudinal sectional view of the same loudspeaker, along III—III of FIG. 2.
Figure 2:
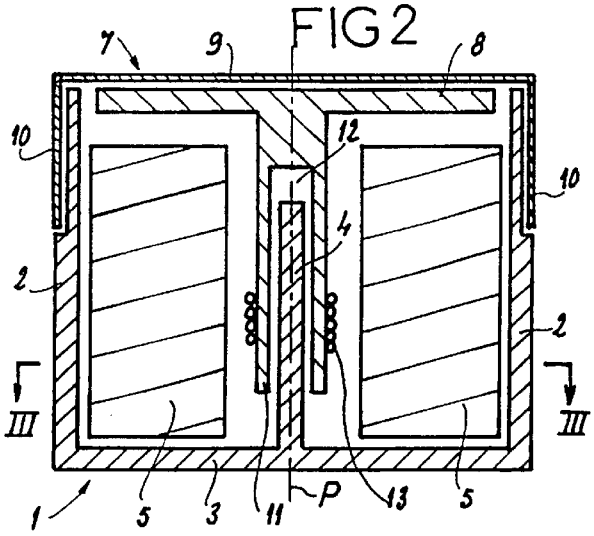
FIG. 2 is a transverse sectional view of this loudspeaker, along II—II of FIG. 1.

FIGS. 1 to 3 give a schematic representation of a linear loudspeaker, which externally takes the form of a body 1 in the shape of an elongate right-angled parallelepiped, possessing for example a length of 50 cm, a width of 2 cm and a depth of 2 cm.

The two longitudinal lateral faces 2 and the base 3 of the body 1 of the loudspeaker form exterior fixed pole parts, supplemented with a central fixed pole part 4, situated in the longitudinal midplane P of the body 1 of the loudspeaker. All these pole parts are advantageously joined together in the form of an "E"-shaped member. Inside the body 1 of the loudspeaker are arranged two fixed permanent magnets 5 of elongate shape, located respectively along the two longitudinal lateral faces 2, above the base 3. The body 1 of the loudspeaker can be closed, at its two ends, by flanges 6 of square or rectangular shape.

Over the upper longitudinal face of the body 1 of the loudspeaker, on the opposite side from the base 3, is stretched an elongate plane diaphragm designated overall by the label 7. The diaphragm 7 is composed of a part made of.

Figure 8:
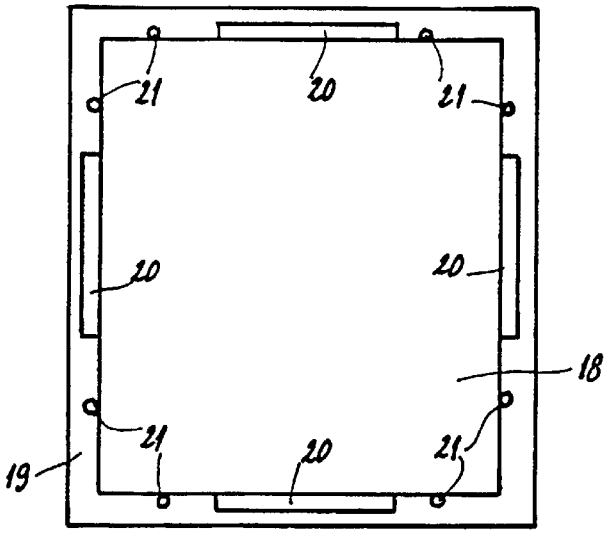
FIG. 8 is a front view of a double glazing with active anti-noise system comprising application of the loudspeaker which is the subject of the invention.
Figure 9:
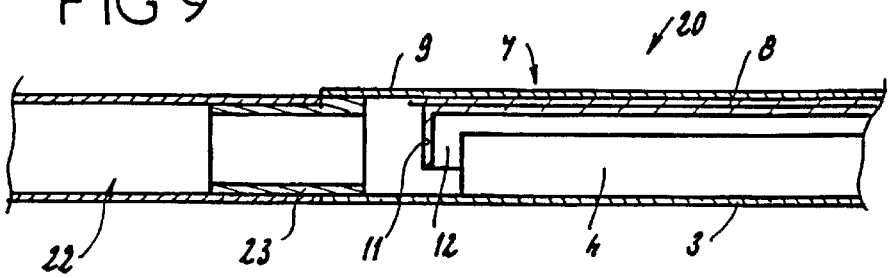
FIG. 9 is a sectional view showing a detail of setup of the loudspeaker, in the application illustrated by FIG. 8.

FIG. 9 is a sectional view showing a detail of setup of the loudspeaker, in the application illustrated by FIG. 8.

FIGS. 1 to 3 give a schematic representation of a linear loudspeaker, which externally takes the form of a body 1 in the shape of an elongate right-angled parallelepiped, possessing for example a length of 50 cm, a width of 2 cm and a depth of 2 cm.

The two longitudinal lateral faces 2 and the base 3 of the body 1 of the loudspeaker form exterior fixed pole parts, supplemented with a central fixed pole part 4, situated in the longitudinal midplane P of the body 1 of the loudspeaker. All these pole parts are advantageously joined together in the form of an "E"-shaped member. Inside the body 1 of the loudspeaker are arranged two fixed permanent magnets 5 of elongate shape, located respectively along the two longitudinal lateral faces 2, above the base 3. The body 1 of the loudspeaker can be closed, at its two ends, by flanges 6 of square or rectangular shape.

Over the upper longitudinal face of the body 1 of the loudspeaker, on the opposite side from the base 3, is stretched an elongate plane diaphragm designated overall by the label 7. The diaphragm 7 is composed of a part made of a lightweight and rigid material 8, in the shape of an elongate rectangular plate, and of a film having elastic properties 9, such as a polyethylene film covering the rigid part 8. The two overhanging longitudinal edges 10 of the elastic film 9 are folded down against the longitudinal lateral faces 2 of the body 1, and are fixed externally to these faces 2 or under the base 3 by gluing or by mechanical crimping by means of an appropriate setup. The elastic film 9 is also attached to the rigid part 8 of the diaphragm 7 by gluing to the upper surface of the rigid part 8, or by overmolding, or else by mechanical crimping by means of an appropriate setup.

The rigid part 8 of the diaphragm 7, in the shape of a plate, is extended towards the inside of the body 1 by a longitudinal wing 11, running in the longitudinal midplane P of the body 1 of the loudspeaker, between the two magnets 5 and towards the base 3, the rigid part thus exhibiting, overall, a "T"-shaped profile. The longitudinal wing 11 possesses a longitudinal recess 12, open toward the base 3, in which is slidably engaged the central fixed pole part 4. A moving electromagnetic coil 13, parallel to the diaphragm 7 and of very elongate profile, is borne by the longitudinal wing 11 which extends the rigid part 8 of the diaphragm 7. The two fixed magnets 5 are thus located outside the moving coil 13 straddling the two large sides of this coil 13. The electrical energizing of the coil 13 causes the vibration of the diaphragm 7, suspended elastically by its elastic film 9 from the fixed part of the loudspeaker, the deformation of the vibrating diaphragm 7 being symmetric on either side of its mean rest position.

Figure 4:
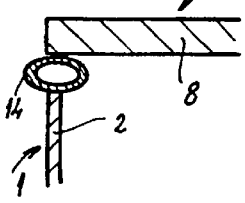
FIGS. 4, 5 and 6 are partial views, in transverse section, showing variants of the suspension of the diaphragm of the loudspeaker.
Figure 5:
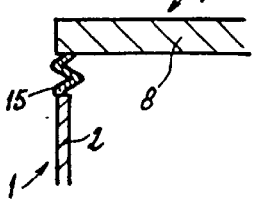
Figure 6:
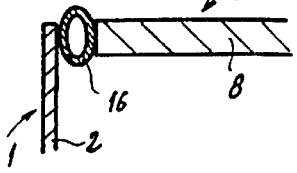

FIGS. 4, 5 and 6 illustrate variants of the suspension of the diaphragm 7 of the loudspeaker, the structure of which is, for the remainder, not modified. In all these variants, the diaphragm 7 proper is limited to its rigid part 8.

In the case of FIG. 4, the join between the diaphragm 7 and the lateral faces 2 of the body 1 of the loudspeaker is effected by an elastic seal 14 in the shape of a roll bead, made for example of rubber, glued on the one hand under the edges of the rigid part 8 of the diaphragm 7, and on the other hand onto the upper rims of the lateral faces 2 of the body 1. The seal 14 is alternately compressed and stretched (in its cross section) during the vibrating motion of the diaphragm 7.

In the case of FIG. 5, the join between the diaphragm 7 and the lateral faces 2 of the body 1 of the loudspeaker is effected by an elastic seal 15 in the shape of a bellows, that is to say exhibiting a zig-zag cross section, which is also glued on the one hand under the edges. of the rigid part 8 of the diaphragm 7, and on the other hand onto the upper rims of the lateral faces 2 of the body 1.

In the case of FIG. 6, the join between the diaphragm 7 and the lateral faces 2 of the body 1 of the loudspeaker is effected by an elastic seal 16 in the shape of a roll bead, glued on the one hand against the edges of the rigid part 8 of the diaphragm 7, and on the other hand against the inside of the lateral faces of the body 1, practically level with the upper rims of these lateral faces 2.

Figure 7:
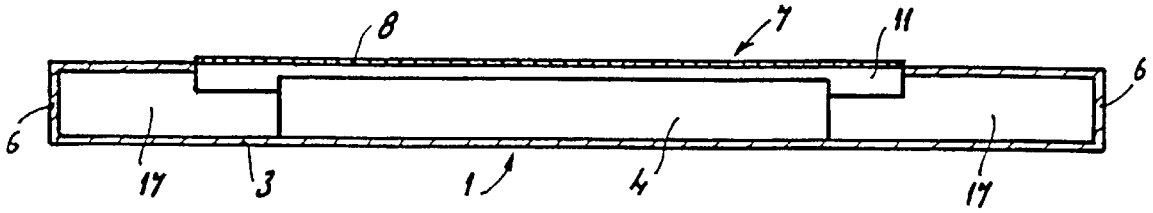
FIG. 7 is a very schematic view of another form of execution of this linear loudspeaker, with tuning volume.

In the form of execution described hitherto, especially with reference to FIGS. 1 to 3, the diaphragm 7 runs over the entire length of the body 1 of the loudspeaker. FIG. 7 shows another form of execution of this linear loudspeaker, in which the diaphragm 7 runs over a fraction of the total length of the body 1 of the loudspeaker, and more particularly only in the middle region of this body. The magnetic components of the loudspeaker are also limited, in their length, to this middle region. Thus, two empty internal spaces 17, which constitute a tuning volume, are formed near the two ends of the loudspeaker, on either side of the region occupied by the diaphragm 7.

FIGS. 8 and 9 illustrate a particular application of the linear loudspeaker described above. The loudspeaker is here a component of an active antinoise system, with which a double glazing 18 is equipped, and is aimed at reducing the noise in the air gap of the double glazing.

Customarily, the double glazing 18 possesses a frame 19, constructed from members, and two parallel glass panes delimiting the air gap. The active anti-noise system consists, in a general manner, of loudspeakers, microphones and control electronics. In the example illustrated in the drawing, this system comprises four linear loudspeakers 20, arranged respectively on the four sides of the frame 19 of the double glazing 18, and eight control microphones 21 also borne by the frame 18. The linear loudspeakers 20 produce a sound field which is sufficient to destroy, by superposition, noises which propagate in the air gap, and this active anti-noise system makes it possible to increase the phonic insulation of the double glazing 18 in the low frequencies.

In this application, each linear loudspeaker 20 can take the form of an independent monobloc component, installed inside a member of the frame 19 of the double glazing 18, in such a way as to construct an invisible anti-noise system which does not reduce the transmission of light through the glass panes.

In a variant, as shown by FIG. 9, each linear loudspeaker 20 can be inserted into an interruption of a member 22 of the frame 19, a joining piece 23 effecting the junction between each end of the body 1 of the loudspeaker 20 and the member 22. This setup makes it possible to benefit from a tuning volume for the loudspeakers 20, in the frame members such as the member 22 which run between these loudspeakers, thereby constructing the equivalent of the configuration according to FIG. 7.

One would not be deviating from the scope of the invention by modifying the exterior dimensions of the loudspeaker, in particular its length, or its constituent materials especially as regards the elastic film of its diaphragm, or else the mode of elastic suspension of the said diaphragm. Thus, in particular, the elastic film of the diaphragm could be fixed not onto the lateral faces of the body of the loudspeaker, but under the base of the loudspeaker, the elastic film possibly enveloping the said body completely.

By the same token, the narrow and elongate shape of the loudspeaker which is the subject of the invention allows its use, for the active processing of noise in an air gap, not only in a double glazing but also in any type of double wall. More generally, the particular shape of this loudspeaker enables it to be inserted into a very small volume, thereby rendering it practically invisible, this also allowing its integration into the actual structure of premises or an item of furniture, or indeed into the structure of a vehicle, or else into ducts, even ones of small cross section, practically without introducing any losses of head. Other dispositions and applications of the linear loudspeaker which is the subject of the invention may thus be: insertion into the casing of a door, for the soundproofing of premises, or mounting in or on discharge or ventilation ducts, for the active processing of noise in these ducts.

What is claimed is:

1. Loudspeaker of elongate overall shape, termed a linear loudspeaker, comprising a parallelepipedal hollow body (1) of elongate shape, a longitudinal face of which consists at least partially of a plane diaphragm (7) of elongate rectangular shape, suspended by its edges (10) from the adjacent lateral faces (2) of the said body (1) or under the base (3) of the said body (1), and integral with an elongate internal rigid wing (11) which runs in the longitudinal direction of the said body (1), substantially in the midplane (P) of the latter, and which bears a moving electromagnetic coil (13) of elongate profile, located between two fixed elongate magnets (5), associated with fixed pole parts, characterized in that the moving electromagnetic coil (13) is parallel to the diaphragm (7), and arranged between two fixed elongate magnets (5) located respectively along two longitudinal lateral faces (2) of the said body (1), these lateral faces (2) and the base (3) of the body (1) forming fixed pole parts, which also comprise a central fixed pole part (4), situated in the longitudinal midplane (P) of the body (1) and received in a longitudinal recess (12) of the internal rigid wing (11) of the diaphragm (7), the said diaphragm (7) thus being stretched in such a way as to allow its symmetric deformation on either side of its position of rest, in the course of the vibrational motion of this diaphragm (7) when the loudspeaker is excited.

2. Linear loudspeaker according to claim 1, characterized in that the elongate plane diaphragm (7) is composed of a rigid part (8), covered with an elastic film (9), and/or comprises such a film, of which the edges (10) are fixed onto the adjacent lateral faces (2) or under the base (3) of the body (1) of the loudspeaker.

3. Linear loudspeaker according to claim 2, characterized in that the edges (10) of the elastic film (9) of the diaphragm (7) are fixed by gluing or by mechanical crimping onto the adjacent lateral faces (2) of the body (1) of the loudspeaker.

4. Linear loudspeaker according to claim 2 characterized in that the elastic film (9) is attached to the rigid part (8) of the diaphragm (7) by gluing or by overmolding or by a mechanical link.

5. Linear loudspeaker according to claim 1, characterized in that the edges of the diaphragm (7) are attached to the adjacent lateral faces (2) of the body (1) of the loudspeaker by way of an elastic peripheral seal (14, 15, 16), especially in the shape of a roll bead or bellows.

6. Linear loudspeaker according to claim 1 characterized in that the diaphragm (7) runs along the entire length of the body (1) of the loudspeaker.

7. Linear loudspeaker according to claim 1 characterized in that the diaphragm (7) runs along a part of the total length of the body (1) of the loudspeaker, the said body (1) thus delimiting near its ends, on either side of the diaphragm (7), two empty internal spaces (7) constituting a tuning volume.

8. A linear loudspeaker according to claim 1 as a component of an active anti-noise system, comprising one or several linear loudspeakers (20) arranged as a border of a double wall, such as double glazing (18), in the air gap between the two walls and/or inside a frame member (19, 22) of this double wall (18).

* * * * *